US006017089A

United States Patent [19]

Mengshoel

[11] Patent Number: 6,017,089

[45] Date of Patent: Jan. 25, 2000

[54] ARRANGEMENT IN A CHAIR, ESPECIALLY FOR REGULATING THE LEVEL OF THE SEAT, ETC.

[76] Inventor: Hans Christian Mengshoel, Prinsessealléen 7, N-0275 Oslo, Norway

[21] Appl. No.: 08/930,738

[22] PCT Filed: Mar. 28, 1996

[86] PCT No.: PCT/NO96/00070

§ 371 Date: Sep. 30, 1997

§ 102(e) Date: Sep. 30, 1997

[87] PCT Pub. No.: WO96/29913

PCT Pub. Date: Oct. 3, 1996

[30] Foreign Application Priority Data

Mar. 8, 1995 [NO] Norway ..... 951236

[51] Int. Cl.[7] ..... A47C 1/00; A47C 3/20

[52] U.S. Cl. ..... 297/338; 297/331; 297/446.2; 297/447.2; 108/116

[58] Field of Search ..... 297/338, 331, 297/339, 446.1, 445.1, 447.2, 446.2, 411.25, 411.38, 344.12, 344.14; 108/116, 117, 147.17; 182/102; 248/157, 297.51

[56] References Cited

U.S. PATENT DOCUMENTS

| | | | |
|---|---|---|---|
| 2,637,371 | 5/1953 | Boutin | 297/338 |
| 4,148,523 | 4/1979 | Brand et al. | 297/338 |
| 4,793,654 | 12/1988 | Takafuji | 297/338 X |
| 5,167,436 | 12/1992 | Wu | 297/338 |
| 5,511,855 | 4/1996 | Miles | 297/338 |

FOREIGN PATENT DOCUMENTS

| | | |
|---|---|---|
| 1086136 | 2/1955 | France . |
| WO95/07641 | 3/1995 | WIPO . |

*Primary Examiner*—Anthony D. Barfield

*Attorney, Agent, or Firm*—Andrus, Sceales, Starke & Sawall

[57] ABSTRACT

An arrangement in a chair especially for regulating the level of the seat, etc., comprising a rack or carrier frame (3) extending upwardly from a base (2), on which carrier frame for example a seat member (4) is removably attached, by detachable holding members (6*a,* 6*b*) for in detached position allowing sliding along said frame (3) for affixing at various levels, and for the purpose of providing an arrangement involving both simplified regulation of chair member level, as well as variation in the appearance of the chair, its field of use and mobility; it is according to the invention suggested that said carrier frame or carrier rack (3; 103; 203; 403) comprises at least one pair or set of substantially parallel elongated members (3*a,* 3*b;* 103*a,* 103*b;* 203*a,* 203*b,* 203*c;* 303*a,* 303*b;* 403*a,* 403*b*) having at least an intermediate slot (5; 105; 205*a,* 205*b;* 305; 405), and that in the area of said slot there are provided chair member carrying holding members (6*a,* 6*b,* 106*a,* 106*b;* 206; 306*a,* 306*b;* 406*a,* 406*b*), which holding means comprise friction elements (7*x,* 7*y,* 7*z;* 107*x,* 107*y,* 107*z;* 207*w,* 207*x,* 207*y,* 207*z*) which in a first chair member carrying position (FIG. 3) will induce a locking effect against the rod-shaped members, and which in a second released position of said chair member carrying members (FIG. 4) will be released from its locking effect against said elongated members for thereby allowing a displacement of said chair member carrying members to various level positions.

15 Claims, 7 Drawing Sheets

ARRANGEMENT IN A CHAIR, ESPECIALLY FOR REGULATING THE LEVEL OF THE SEAT, ETC.

FIELD OF THE INVENTION

The present invention relates to an arrangement in a chair, especially for regulating the level of the seat, etc., comprising a rack or carrier frame extending upwardly from a base, on which carrier frame for example a seat member is removably attached, by detachable holding means for in detached position to allow sliding along said frame for affixing in a new level position.

PRIOR ART

From U.S. Pat. No. 2,712,348 (J. E. Cooper) there is known a dental chair, comprising a seat member carried by a vertical rod which in turn can be moved in a vertical shaft. The rod is provided with a plurality of ring-shaped recesses communicating with a T-shaped guiding pin for adjusting the seat at various levels.

From FR 1 086 136 (Legrand) there is known a corresponding dental chair, wherein the level regulation of the seat takes place in that a carrier rod provided with a plurality of holes can be guided up and down in a vertical pipe, the level position of the seat being determined by passing a bolt through an appropriate hole, at the same time as the bolt will abut against recesses uppermost in the vertical pipe.

OBJECT OF THE INVENTION

An object of the present invention is to provide an arrangement in a chair, of the type as mentioned in the preamble, which in a simpler and safer manner will allow alteration of the seat level, etc.

Another object of the present invention is to provide an arrangement in a chair, which can be designed by relatively simple basic elements, but which nevertheless will render large freedom of choice as regards embodiment and rational use.

Still another object of the present invention is to provide arrangements in chairs which can be manufactured from various types of material, but which nevertheless render a large degree of freedom of the choice of possible design shapes, it being chairs for home use or office use, conference chairs, working chairs, etc.

Yet another object of the present invention is to provide arrangements in chairs, wherein both seat, back support and neck support can be chosen optionally, at the same time as the same can be regulated within wide ranges.

SUMMARY OF THE INVENTION

Such objects can be realized in an arrangement as stated in the preamble, which according to the invention is characterized by the features appearing from the appending patent claims.

Further features and advantages, as well as specific embodiments of the invention, will appear from the following description taken in connection with the drawings, as well as from the appending patent claims.

DESCRIPTION OF EMBODIMENTS

Figure 1:
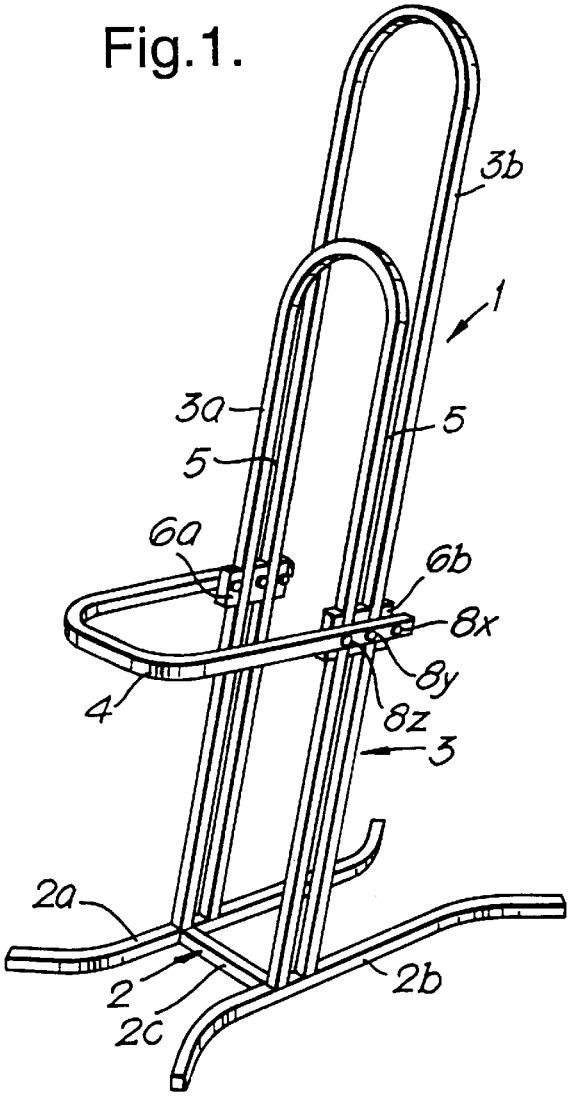
FIG. 1 is a perspective view of a first embodiment of an arrangement in a chair according to the invention, wherein in only the basic rack and a seat hoop are illustrated.

In FIG. 1 there is perspectively illustrated a view of a first embodiment in a chair according to the invention, wherein the arrangement, itself is designated by reference numeral 1, and wherein only the basic rack or carrier frame and a seat hoop are illustrated for the sake of survey.

The arrangement 1 itself thus comprises a base 2 comprising two substantially parallelly extending side legs 2*a* and 2*b*, respectively, having an intermediate yoke 2*c*. From the base 2 there extends upwardly a carrier frame or rack which here is generally designated by reference numeral 3, and which is so adapted that a hoop 4 which can constitute the support of a seat, or similar, can be regulated to various height levels. The carrier frame or rack 3 comprises at least a pair of substantially parallel elongated means, here provided as two substantially hoop-like means 3*a* and 3*b*, respectively, which therebetween define an intermediate slot S. In the area of the slot, or slots 5, there are provided individual holding means 6*a* and 6*b*, respectively, as this is illustrated on a larger scale in FIGS. 3 and 4.

It is to be understood that in a first embodiment the hoop-shaped substantially parallelly elongated pipe- or rod-shaped means 3*a*, 3*b* can have such a shape as regards the choice of material and dimensions, that the intermediate slot 5 can be regulated by mutual flexibility between said hoop-shaped means 3*a*, 3*b*. This involves that the seat carrying hoop 4, as this is illustrated in detail in FIG. 3, in a first, here for example approximately horizontal position, will allow the holding means 6*a*, 6*b* to exercise a clamping effect of the rod-shaped means 3*a*, 3*b*, such that the holding means 6*b* themselves including their respective friction elements, here the three respective friction elements 7*x*, 7*y*, 7*z*, will come in frictional contact between said longitudinal means 3*a*, 3*b*.

However, it is to be understood that in other embodiments the longitudinal pipe- or rod-shaped means can be stiffer, such that the slot therebetween will be less flexible, which requires a somewhat different design of the respective holding means and the friction elements thereof.

Figure 3:
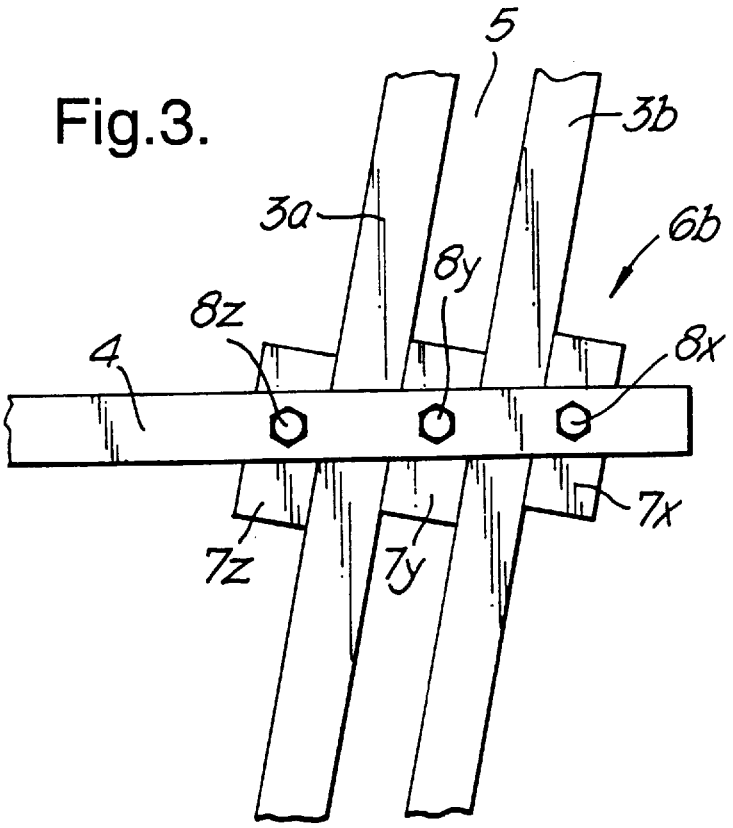
FIG. 3 illustrates in side view and on a larger scale details of a first embodiment of holding means according to the present invention, in a first locking position.

In FIG. 3 it is thus illustrated that the rod-shaped means 3*a*, 3*b* have been pressed somewhat together higher up, which is due to the fact that the means 3*a*, 3*b* at the top, see FIG. 1, lack any mutual connection.

Figure 4:
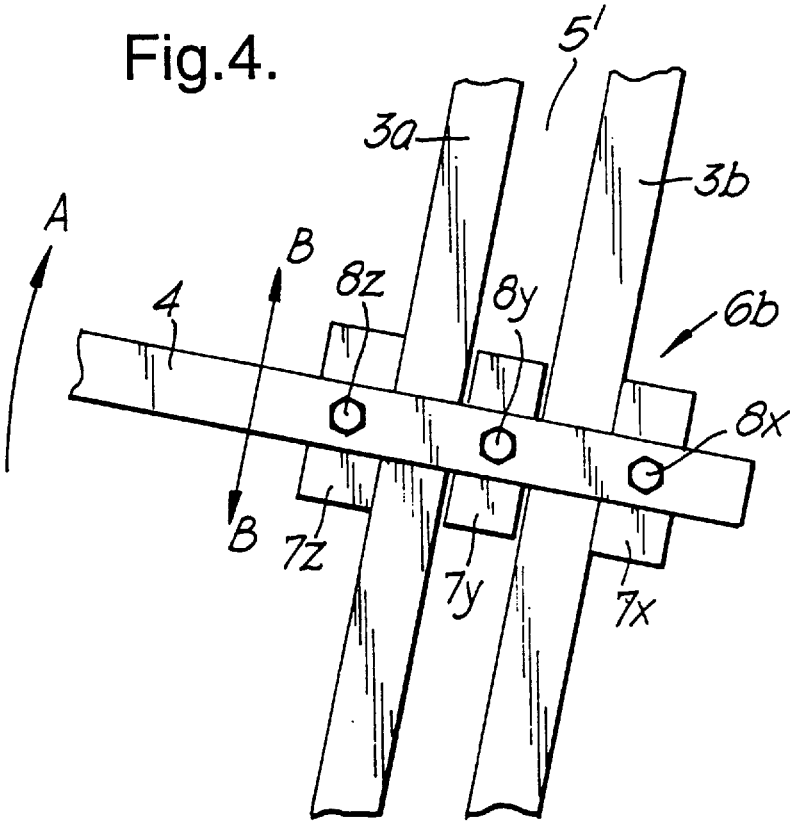
FIG. 4 is a view similar to FIG. 3 and illustrates the holding means in a second released position.

If the seat hoop 4, as this is illustrated in FIG. 4, is lifted somewhat upwards in the direction of the arrow A, such that the hoop 4 will take an inclined angle, the rod-shaped means 3*a*, 3*b* will be displaced somewhat from each other, for thereby taking a substantially parallel position in relation to each other, and thereby appropriately widening the slot 5' somewhat, such that the hoop 4 as such can more easily be guided upwardly or downwardly, as indicated by the double arrow B—B, and consequently change the seat level as required.

After the regulation has been finished, the seat hoop 4 can be moved back to the substantially horizontal position as illustrated in FIG. 3, whereafter the friction elements 7*x*–7*z* once again will be in contact with the respective hoop-shaped longitudinal means 3*a*, 3*b*, possibly in the now somewhat narrower slot 5, especially as regards the friction elements 7*y*, but also on opposite zones of the hoops in relation to said slot, which is specifically the case for the "outer" friction elements 7*x* and 7*z*.

If no flexible affect had existed between the two hoop-shaped means 3*a*, 3*b*, it would have been the inclined position of the friction elements 7*x*–7*z* which would have been determining as regards the locking position illustrated in FIG. 3 and the regulating position illustrated in FIG. 4.

In FIGS. 1, 3 and 4 it is illustrated that said friction elements 7*x*–7*z* are affixed by means of throughgoing bolts 8*x*, 8*y* and 8*z*, respectively, which affixing is so adapted that a small turning movement can be allowed for the respective friction elements 7*x*–7*z*. This involves that said means 8*x*–8*y* will allow a small turning of the respective elements for in a first locking position to induce a friction effect against said rod-shaped means, and in a second position to be released from said friction effect.

Figure 2:
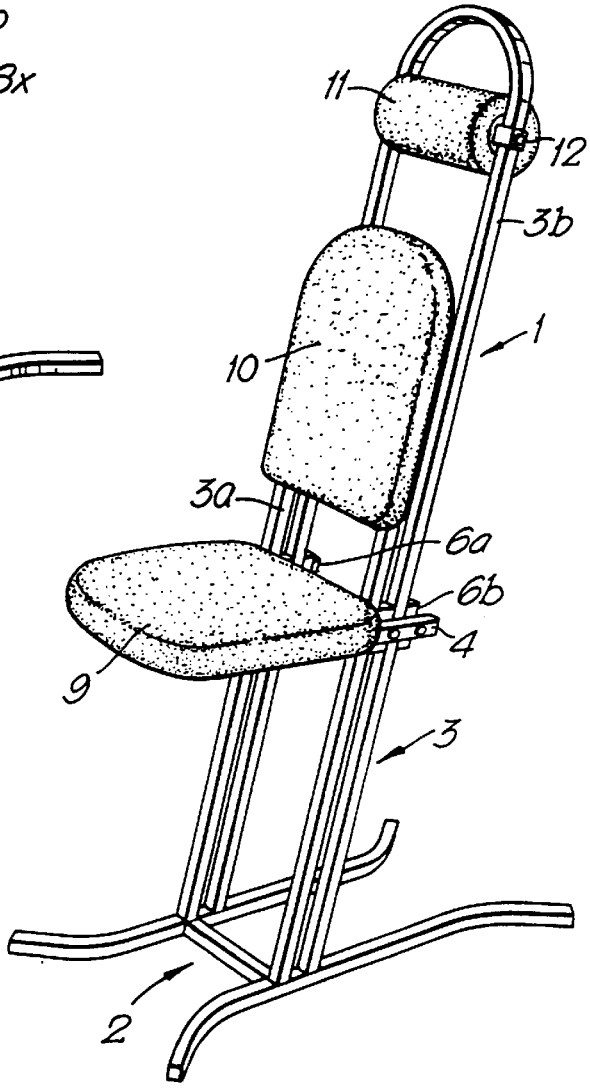
FIG. 2 is a schematic view similar to FIG. 1, wherein the embodiment here is illustrated with an upholstered seat and attached back support and neck support.

FIG. 2 is a schematic view similar to FIG. 1, but herein the previously discussed seat hoop 4 is provided with an upholstered seat 9, which can have its level regulated by means of said seat hoop 4 and said previously discussed seat member carrying holding means 6*a*, 6*b*. Besides, the chair according to FIG. 2 is provided with a back support 10 which for example can be permanently mounted at the upper portion of the front hoop 3*a*, as well as being provided with a neck support 11 affixed at the upper portion of the second hoop 3*b*, for example by means of attachment means 12 which have been adapted for level adjustment of said neck support 11.

Figure 5:
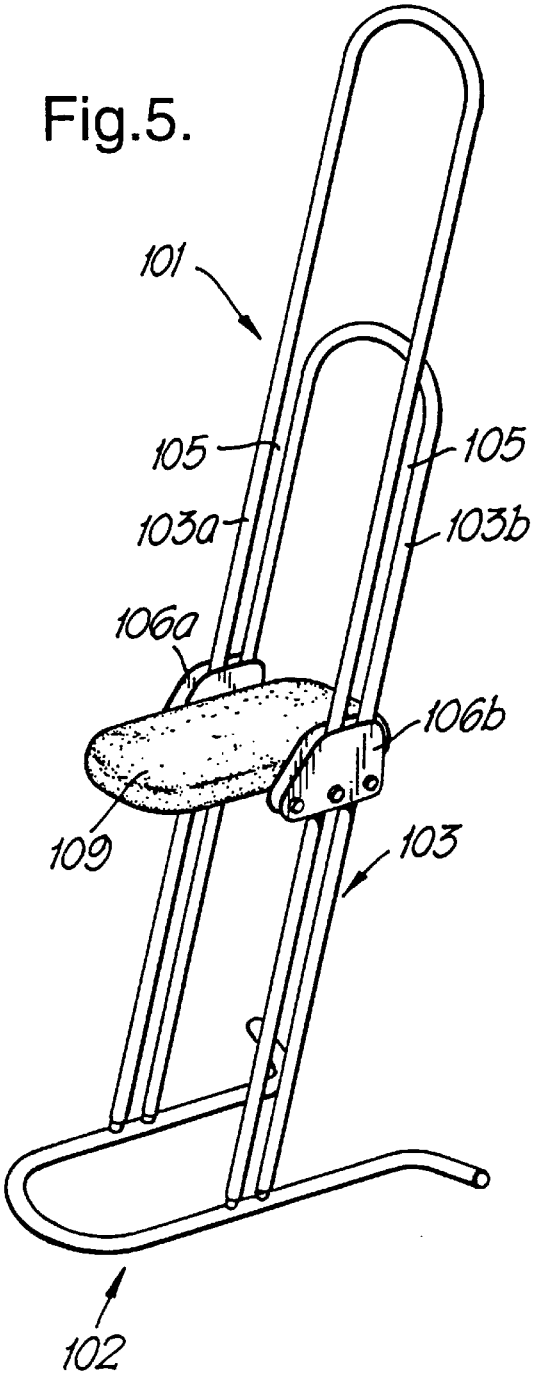
FIGS. 5 and 6 are schematic perspective views of a second and third embodiment, respectively, of an arrangement in a chair according to the invention, provided with a second embodiment of holding means according to the invention.
Figure 6:
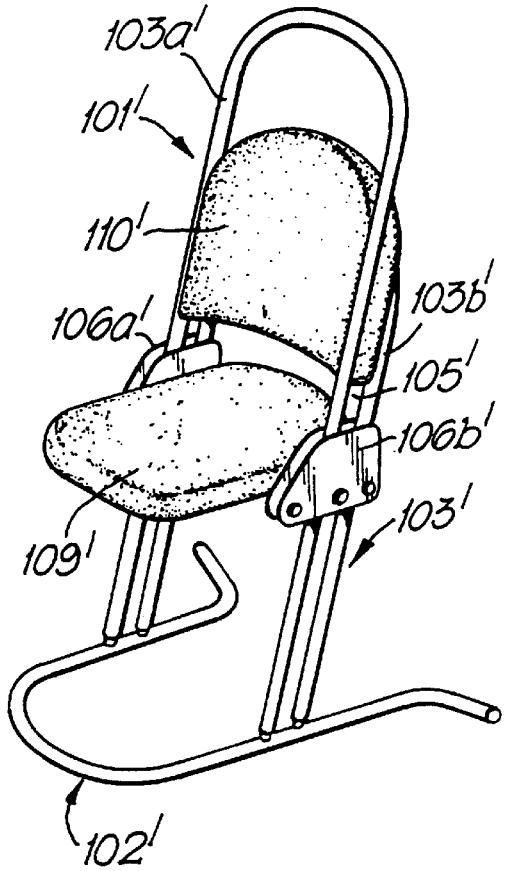

In FIGS. 5 and 6 there are perspectively illustrated views of a second and a third embodiment, respectively, of an arrangement in a chair according to the invention, both mentioned embodiments being provided with a second embodiment of holding means according to the invention.

Consequently, FIG. 5 illustrates an arrangement 101 having the same elements as illustrated in FIGS. 1 and 2, but with reference numerals in 100-series, whereas FIG. 6 illustrates an arrangement 101' having the same elements as illustrated in FIG. 2, but in 100'-series.

The difference between the embodiments according to FIGS. 5 and 6, in relation to the previously discussed embodiments according to FIGS. 1–4, reside in the embodiment itself of the holding means 106*a*, 106*b*, respectively, of the arrangement according to FIG. 5, as well as the holding means 106*a*', 106*b*' *of the embodiment according to FIG. 6.*

Figure 7:
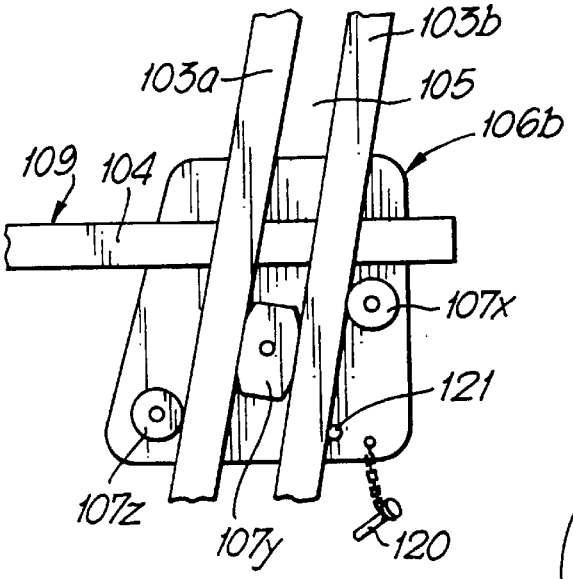
FIG. 7 illustrates in side view and on a larger scale details of a second embodiment of holding means according to the present invention, in a first locking position.
Figure 8:
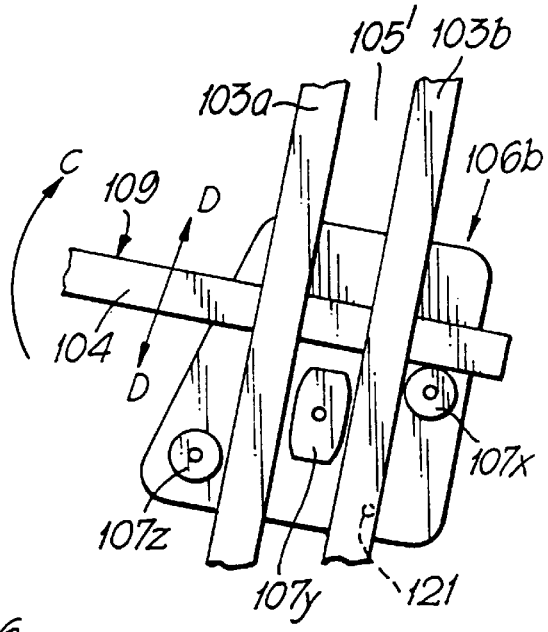
FIG. 8 is a side view similar to FIG. 7, and illustrates the holding means in a second released position.

These differences are illustrated in further details in FIGS. 7 and 8, wherein FIG. 7 with reference specifically to FIG. 5, in side view and on a larger scale illustrates the seat 109 with its seat hoop 104 in an approximately horizontal position, which involves that the individual friction elements 107*x*, 107*y* and 107*z* will have a clamping and affixing friction effect in the slot 105 between the respective longitudinal pipe- or rod-shaped means 103*a* and 103*b*, as well as against outer portions thereof.

In FIG. 8 the seat 109 with its hoop 104 has been lifted somewhat in relation to the position illustrated in FIG. 7, which is indicated by the arrow C. If one also here uses hoops without any permanent connection at the top, this will involve that the slot 105' between the elongated means 103*a* and 103*b* can be expanded somewhat for thereby rendering a larger clearance for the central friction element 107*y*, such that the seat frame 104 together with said holding means 106*a*, 106*b* more easily can be displaced upwardly or downwardly, see the double arrow D—D. It is to be understood that the outer friction elements 107*x* and 107*y* can here be designed as cylinder-shaped rollers, or similar, manufactured from an appropriately soft material, for example plastic or rubber, whereas the central friction element 107*y* may have a somewhat elongated shape with appropriate abutting surfaces which can render an appropriate large friction contact when said friction elements induce a friction locking effect, this taking place either by pressing together said hoops to provide a narrower slot therebetween, or by an appropriate inclined position of said friction elements. It is also to be understood that said central friction element 107*y* can have not only a different design, but can also be manufactured from material having different elastic characteristics that the opposite, outer friction elements 107*x* and 107*z*.

In order to avoid unintended regulation of the chair seat 109 there may appropriately be provided a locking bolt 120, which appropriately can be inserted in a hole 121 in the outer fittings constituting the holding means 106*b*, which involves that by inserted locking bolt 120 in the hole 121 the seat 109 with said seat frame 104 cannot be moved out from the approximately horizontal locking position illustrated in FIG. 7, wherein specifically the central friction element 107*y* induces its friction effect, whereas the outer friction elements 107*x* and 107*z* function in a manner which can be compared with a pole climber.

Figure 9:
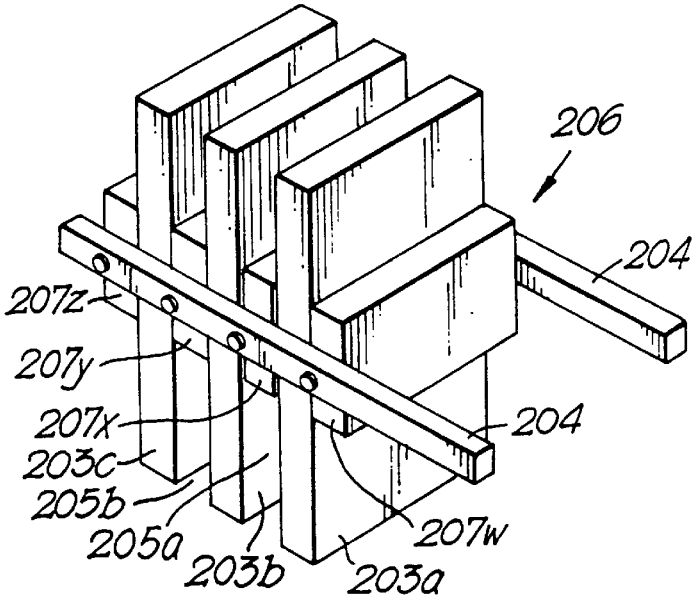
FIG. 9 is a perspective view on a larger scale illustrating details in a third embodiment of the holding means according to the present invention.

In FIG. 9 there is illustrated a perspective view on a larger scale of details of a third embodiment of holding means according to the present invention, here generally designated by reference numeral 206, whereas a seat carrying hoop is designated by reference numeral 204, there being here provided not only two but three substantially vertically protruding parallel means 203*a*, 203*b* and 203*c*, respectively, which involves that between said means there will be provided two slots 205*a* and 205*b*, respectively. Further, the holding means 206 itself comprises four friction elements 207*w*, 207*x*, 207*y* and 207*z*, respectively, having the same functional properties as the previously discussed friction elements. It is to be understood that the substantially parallel upwardly extending means 203*a*, 203*c* can be provided as plank-shaped means extending along the overall width of the seat hoop 204, or a similar hoop which is to carry a chair member, which has been depicted in further details in FIG. 10.

Figure 10:
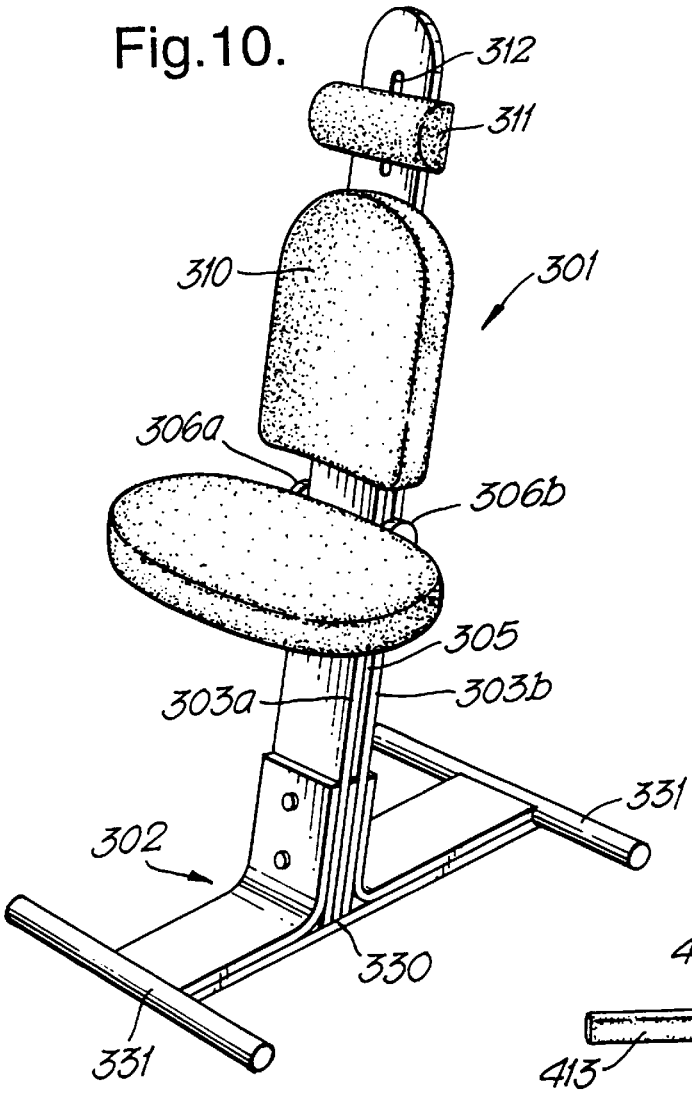
FIG. 10 is a perspective view of still another variant of an arrangement in a chair according to the invention, including a specific form of longitudinal means.

In FIG. 10, which is founded on the principle according to FIG. 9, there is illustrated perspectively a further variant of an arrangement 301 according to the present invention, comprising a base 302 carrying two plank-shaped substantially parallelly upwardly extending rack or frame means 303*a* and 303*b*, respectively.

Between said parallel upwardly extending means 303*a* and 303*b* there is consequently defined a slot 305 and in the area of said slot 305 there are provided chair member carrying holding means 306 and 306*b*, which in this case carry a chair seat 309 which in an appropriately upwardly tilted position can release said holding means 306*a* and 306*b* for regulating the seat level in relation to the ground or the base 302. The arrangement is also here provided with a possibly level adjusting back support 310 as well as an adjustable neck support 311, which adjustment can be effected for example along a recess 312 in the upper portion of the rear plank-shaped upwardly extending means 303*b*. The base 302 comprises here an elongated main member 330, wherefrom at each end there is protruding a crossing arm 331.

Figure 11:
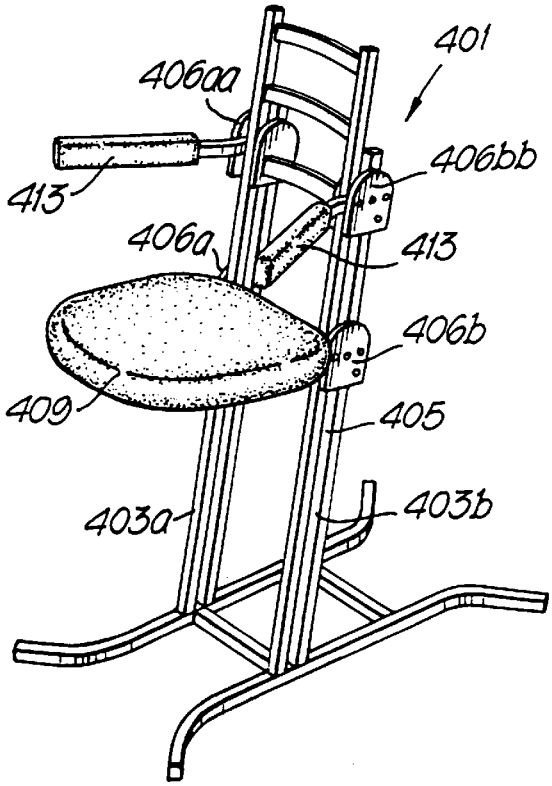
FIG. 11 is a perspective view of yet another variant of an arrangement in a chair according to the invention, provided with a specific embodiment of arm rests.

In FIG. 11 there is perspectively illustrated still another variant of the arrangement 401 of a chair according to the invention, comprising a base 402 which otherwise carries substantially parallel elongated pipe- or rod-shaped means 403*a* and 403*b*, defining therebetween a slot 405, as well as holding means 406*a* and 406*b* which here carry a seat 409 which, in a similar manner as discussed previously, can have its level regulated. Besides, the arrangement 401 comprises further holding means 406*aa* and 406*bb* carrying arm rests 413 which can also have the level thereof regulated.

Figure 12:
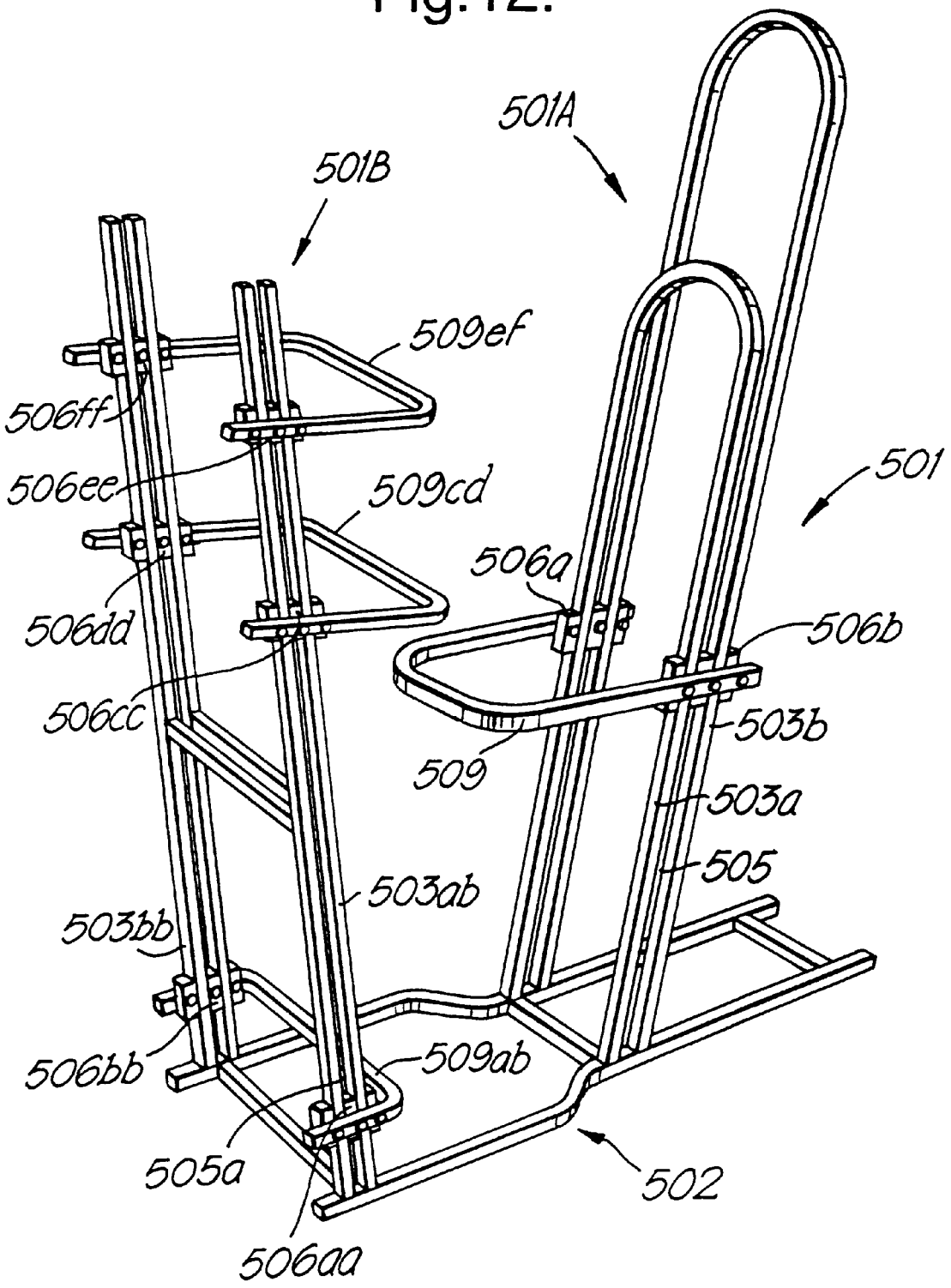
FIG. 12 is a perspective view of the frame of still another variant of an arrangement according to the invention, wherein the chair member is built together with a table member.

In FIG. 12 there is illustrated the frame work of still another embodiment of an arrangement 501 according to the invention. The arrangement 501 comprises here a common base 502 which carries a chair member 501A and a table member 501B, respectively.

The chair member 501A comprises a first set of elongated pipe- or rod-shaped means 503*a* and 503*b*, defining therebetween a slot 505, as well as holding means 506*a* and 506*b* which here carry a seat hoop 509 which can have its level regulated.

Correspondingly, said table member 501B comprises a second set of substantially pipe- or rod-shaped means 503*aa* and 503*bb* defining therebetween a slot 505*a*. In the slot 505*a* there are provided three different sets of holding means, a lower set 506*aa* and 506*bb* carrying a lower hoop 509*ab*, a central set of holding means 506*cc* and 506*dd* having a central hoop 509*cd*, as well as an upper set of holding means 506*ee* and 506*ff* carrying an upper hoop 509*ef*.

Figure 13:
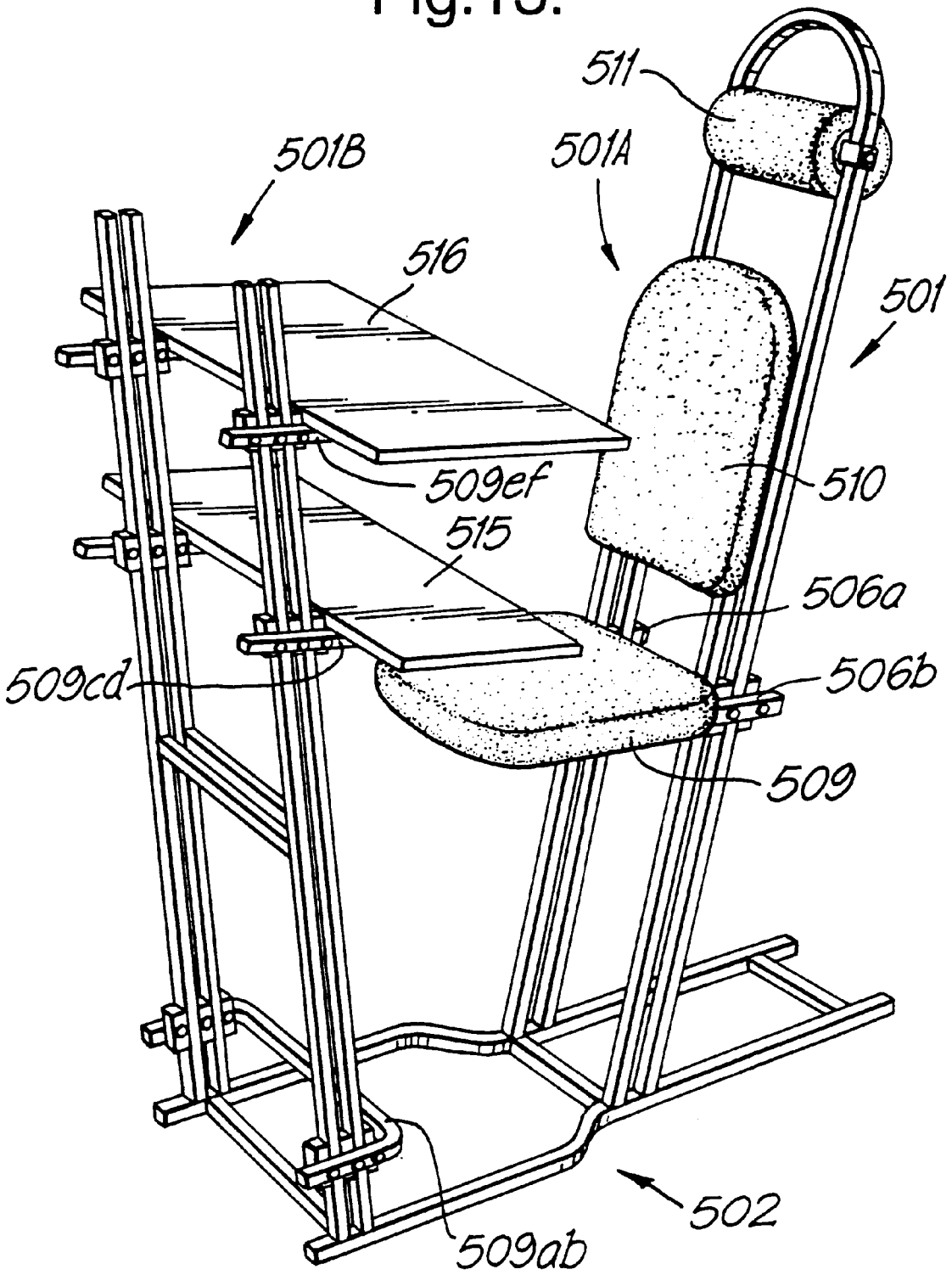
FIG. 13 illustrates perspectively the same frame as in FIG. 12, but here provided with seat, back support and neck support on the chair member, as well as two table plates on the table member.

It is to be understood that all of said hoops 509*ab*, 509*cd* and 509*ef* of the table member 501B can have its level regulated, in the same manner as discussed previously, and in the same manner as said chair hoop 509 of said chair member 501A, which involves that the arrangement 501 can constitute an adjustable working place, for example a mobile working place as illustrated in FIG. 13.

In FIG. 13 it is illustrated that the chair member 501A has been provided with a chair member 509, a possibly adjustable back support 510 and an adjustable neck support 511, and that the chair member 501B has been provided with an upper plate 516 carried by the upper adjustable hoop 509*ef*, and a central plate 515 carried by said central hoop 509*cd*, whereas bottom hoop 509*ab* possibly can constitute a support for a not illustrated foot support.

It is to be understood that said illustrated arrangement of course can be varied within wide limits in view of the principle suggested by the invention. Further, it is to be understood that the arrangement according to the invention can be used not only for carrying chair seats, back supports, neck supports, etc., but can be used for carrying arm supports, as well as other means or facilities serving for alternative use and sitting positions. Further, it is to be understood that the position of for example a seat not necessarily must be horizontal in its locking position, but can take any slanting downwardly extending or slanting upwardly extending locked position, provided the seat will allow for a release by further lifting of the seat front and seat adjustment in said released position.

Further, it is to be understood that the embodiments illustrated specifically in FIGS. 9 and 10, can be provided with friction elements having undulated surfaces, which undulated surfaces may then correspond to opposite undulated surfaces of the substantially parallel elongated means protruding upwardly from the base of said arrangement.

It is also to be understood that the seat or other chair members can be permanently locked, not only by means of pins or bolts and corresponding recesses, but also by means of appropriate knobs or wheels or screws having an inherent tightening function. Possibly, there may be used a spring loaded locking means.

It can also, as for example illustrated in FIG. 11, be used arm rests on the other illustrated embodiments, and such members can be permanent or adjustable according to the same principles as discussed previously.

The arrangement according to the invention can of course include various shapes of the base, for example stationary or mobile, depending on the field of use, which is also the case for those types of arrangements having common base and constituting so-called combined arrangements or combined furniture.

What is claimed is:

1. A support arrangement of an article of furniture for providing adjustment in an elevation of a furniture component forming a part of the article of furniture, wherein the article of furniture defines a front and a rear and includes a carrier frame extending upwardly from a base and a support member movably mounted to the carrier frame for adjusting the position of the support member on the carrier frame, wherein the carrier frame includes at least one pair of elongated members which define a slot therebetween and wherein a furniture component holding means is located in the vicinity of the slot and includes at least a pair of friction elements, characterized in that the elongated members are spaced apart from each other in a front-rear direction such that the slot opens in a direction transverse to the front-rear direction, and in that the friction elements are arranged in spaced relationship to each other in a front-rear direction and one of the friction elements is located within the slot, wherein the friction elements are movable between an operative position in which the friction elements induce a locking effect on at least one of the elongated members, and a release position in which the friction elements are released from engagement with the elongated members in response to an upward force exerted on the furniture component for allowing movement of the furniture component relative to the carrier frame.

2. Arrangement as claimed in claim 1, characterized in that said friction elements are suspended in means allowing for a small turning of said friction elements between the operative position to induce friction effect against said elongated members, and the release position to be released from said friction effect.

3. Arrangement as claimed in claim 1, characterized in that said elongated members are provided without an upper connection, such that said elongated members can be pressed resiliently to and from each other for appropriate enlargement of the slot therebetween and thereby respectively amplify or release the locking effect between said elongated members and said friction elements.

4. Arrangement as claimed in claim 1, characterized in that said carrier frame comprises a pair of substantially parallel elongated members provided on each side of a central plane of said article of furniture and defining a slot therebetween.

5. Arrangement as claimed in claim 4, characterized in that said pair of substantially parallel elongated members comprise individual front and rear members, each front member having a top defining a first arch, and each rear member having a top defining a second arch.

6. Arrangement as claimed in claim 1, characterized in that said elongated members comprise at least two substantially parallel elongated plank-shaped members having at least one slot therebetween.

7. Arrangement as claimed in claim 6, characterized in that said plank-shaped members are engageable with said friction elements which extend substantially along the overall width of said plank-shaped members.

8. Arrangement as claimed in claim 1, characterized in that said friction elements are manufactured from an elastic material.

9. Arrangement as claimed in claim 1, characterized in that said friction elements are manufactured from metal pieces having a width corresponding to the slot.

10. Arrangement as claimed in claim 1, characterized in that one carrier frame is provided on a common base together with a functionally similar carrier frame for constituting a combined article of furniture.

11. Arrangement as claimed in claim 1, characterized in that said arrangement further comprises a locking means for locking said furniture component for avoiding unintended movement of said furniture component.

12. A support arrangement for an article of furniture, comprising:

a pair of carrier frames extending upwardly from a common base, wherein each carrier frame comprises a pair of elongated members arranged one behind the other and which define a slot therebetween; and a furniture component support engaged with each carrier frame, wherein each furniture component support includes a support member carrying a furniture component, and a locking member mounted to the support member and located within the slot, wherein the locking member is configured to induce a locking effect against the pair of elongated members when subjected to a load for maintaining the furniture component in position relative to the base, and wherein the locking member is movable to a release position within the slot in response to upward movement of the support member to provide movement of the furniture component support relative to the base for adjusting the position of the furniture component relative to the carrier frames.

13. Arrangement as claimed in claim 12, characterized in that one of said members in each pair constituted a first higher arch, whereas the other of said members in each pair constitutes a lower arch.

14. In an article of furniture including a base and a furniture component extending in a forward-rearward direction and adapted to be supported by the base, the improvement comprising a pair of elongated members mounted to the base and extending upwardly therefrom, wherein the pair of elongated members are spaced apart from each other and define an elongated slot therebetween which opens in a direction transverse to the forward-rearward direction, and a support arrangement interconnected with the furniture component, wherein the support arrangement includes a locking member located within the slot between the first and second elongated members, wherein the support arrangement is movable between an operative position in which the locking member is engaged with the elongated members to support the article of furniture, and a release position in which the locking member is movable within the slot relative to the elongated members to provide movement of the article of furniture.

15. The improvement of claim 14, wherein the support arrangement includes a pair of locking members, wherein a first one of the locking members is located within the slot and a second one of the locking members is located exteriorly of the slot adjacent one of the elongated members, wherein when the support arrangement is in its operative position, the first and second locking members are operable to clamp the elongated member therebetween to maintain the support arrangement, and thereby the article of furniture, in a desired position.

* * * * *